US005367634A

United States Patent [19]

Nakamura

[11] Patent Number: 5,367,634

[45] Date of Patent: Nov. 22, 1994

[54] DISPLAY METHOD, CONTROL CIRCUIT FOR THE SAME AND DISPLAY DEVICE

[75] Inventor: Katsutoshi Nakamura, Suwa, Japan

[73] Assignee: Seiko Epson Corporation, Nagano, Japan

[21] Appl. No.: 903,526

[22] Filed: Jun. 24, 1992

[30] Foreign Application Priority Data

Jun. 27, 1991 [JP] Japan ..... 3-156421
May 15, 1992 [JP] Japan ..... 4-123777

[51] Int. Cl.[5] ..... G09G 1/16
[52] U.S. Cl. ..... 345/194; 345/143
[58] Field of Search ..... 340/730, 747, 793, 799, 340/781; 345/143, 144, 192, 194, 195

[56] References Cited

U.S. PATENT DOCUMENTS 4,283,724 8/1981 Edwards ..... 340/781
4,404,552 9/1983 Hirahata et al. ..... 340/747
4,595,996 6/1986 Morley et al. ..... 340/799
4,808,991 2/1989 Tachiuchi et al. ..... 340/793
4,849,747 7/1989 Ogawa et al. ..... 340/730

*Primary Examiner*—Ulysses Weldon
*Assistant Examiner*—Gin Goon
*Attorney, Agent, or Firm*—Spensley Horn Jubas & Lubitz

[57] ABSTRACT

There is disclosed a display system for outputting image data of a bit map to be displayed on a raster scan type display and a pattern of font corresponding to a code of a character, symbol or graphics having the predetermined code assigned thereto to the display for displaying the image and the character, symbol or graphics corresponding to the code on the display, comprising the steps of adding identification data for discriminating the code from the image data to the code and storing the code in a memory together with the image data, sequentially reading the code together with the image data from the memory, and outputting a pattern of the font corresponding to the code having the identification data added thereto to the display when the identification data is detected.

19 Claims, 12 Drawing Sheets

100
101
102
103
DATA X
X1
X2
DATA Y
Y1
Y2
X1
Y1
DISCRIMINATE
111
A2
FONT TABLE
110
Y2a
Y2b
ATTRIBUTE
C
406

Fig. 5A

ROW ADDRESS

| | | | | | | | | | |
|---|---|---|---|---|---|---|---|---|---|
| 1 | 0 | 0 | 1 | 0 | 0 | 0 | 1 | 0 | 0 | 0 | 0 |
| 1 | 0 | 0 | 0 | 0 | 0 | 1 | 0 | 1 | 0 | 0 | 0 |
| 0 | 1 | 1 | 1 | 0 | 1 | 0 | 0 | 0 | 1 | 0 | 0 |
| 0 | 1 | 1 | 0 | 1 | 0 | 0 | 0 | 0 | 0 | 1 | 0 |
| 0 | 1 | 0 | 1 | 1 | 0 | 0 | 0 | 0 | 0 | 1 | 0 |
| 0 | 1 | 0 | 0 | 1 | 0 | 0 | 0 | 0 | 0 | 1 | 0 |
| 0 | 0 | 1 | 1 | 1 | 1 | 1 | 1 | 1 | 1 | 1 | 0 |
| 0 | 0 | 1 | 0 | 1 | 0 | 0 | 0 | 0 | 0 | 1 | 0 |
| 0 | 0 | 0 | 1 | 1 | 0 | 0 | 0 | 0 | 0 | 1 | 0 |
| 0 | 0 | 0 | 0 | 1 | 0 | 0 | 0 | 0 | 0 | 1 | 0 |

Fig. 5B

ROW ADDRESS

| | | | | | | | | | |
|---|---|---|---|---|---|---|---|---|---|
| 1 | 0 | 0 | 1 | 0 | 0 | 0 | 0 | 0 | 0 | 0 | 0 |
| 1 | 0 | 0 | 0 | 1 | 1 | 1 | 1 | 1 | 1 | 0 | 0 |
| 0 | 1 | 1 | 1 | 1 | 0 | 0 | 0 | 0 | 0 | 1 | 0 |
| 0 | 1 | 1 | 0 | 1 | 0 | 0 | 0 | 0 | 0 | 1 | 0 |
| 0 | 1 | 0 | 1 | 1 | 0 | 0 | 0 | 0 | 0 | 1 | 0 |
| 0 | 1 | 0 | 0 | 1 | 1 | 1 | 1 | 1 | 1 | 0 | 0 |
| 0 | 0 | 1 | 1 | 1 | 0 | 0 | 0 | 0 | 0 | 1 | 0 |
| 0 | 0 | 1 | 0 | 1 | 0 | 0 | 0 | 0 | 0 | 1 | 0 |
| 0 | 0 | 0 | 1 | 1 | 0 | 0 | 0 | 0 | 0 | 1 | 0 |
| 0 | 0 | 0 | 0 | 1 | 1 | 1 | 1 | 1 | 1 | 0 | 0 |

| | | | | | | | | |
|---|---|---|---|---|---|---|---|---|
| ROW 1 | 1 | 1 | 0 | 0 | 1 | 0 | 0 | 1 |
| ROW 2 | 1 | 1 | 0 | 0 | 0 | 0 | 0 | 1 |
| ROW 3 | 1 | 0 | 1 | 1 | 1 | 0 | 0 | 1 |
| ROW 4 | 1 | 0 | 1 | 1 | 0 | 0 | 0 | 1 |
| ROW 5 | 1 | 0 | 1 | 0 | 1 | 0 | 0 | 1 |
| ROW 6 | 1 | 0 | 1 | 0 | 1 | 0 | 0 | 1 |
| ROW 7 | 1 | 0 | 1 | 0 | 1 | 0 | 0 | 1 |
| ROW 8 | 1 | 0 | 1 | 0 | 0 | 0 | 0 | 1 |
| ROW 9 | 1 | 0 | 0 | 1 | 1 | 0 | 0 | 1 |
| ROW 10 | 1 | 0 | 0 | 1 | 0 | 0 | 0 | 1 |
| ROW 11 | 1 | 0 | 0 | 0 | 1 | 0 | 0 | 1 |
| ROW 12 | 1 | 0 | 0 | 0 | 0 | 0 | 0 | 1 |

DISPLAY METHOD, CONTROL CIRCUIT FOR THE SAME AND DISPLAY DEVICE

BACKGROUND OF THE INVENTION

1. Field of the Invention

The present invention relates to an application of a display device used as a terminal of an information processing system, and more particularly to a display device which displays a plurality of images displayed at a fixed or semi-fixed scale such as a character, symbol or graphics having a predetermined code assigned thereto, at any desired position, and graphically displays image data of a bit map on a graphic memory.

2. Related Background Art

Of raster scan type graphic displays (hereinafter referred to as display devices), a bit map display device is primarily designed to display picture images such as line drawings and drawings and it is usually not suitable for displaying only a text.

FIG. 1 shows a prior art common display device 400. When an image is to be displayed on an image screen 406, a drawing unit (CPU and DMA controller) 401 writes image data into an image memory 402, and when character are to be displayed, it writes character codes into a character memory 403. The character codes are read from the character memory 403 in synchronism with the scan of the image screen 406 and they are converted to image data of the characters corresponding to the codes by a character font table 404. It is combined with the image memory 402 by a combine circuit 405 and sent to the image screen 406 for displaying the image of the characters. When as character is to be updated, the drawing unit 401 updates only that character code of the character memory 403 to facilitate the edition of the text. Such a prior art system is called a duplex display device.

In this system, since the memories are provided for the characters and the images, a control unit such as a memory read circuit has an image memory read circuit 412 for the image memory 402 and a control circuit 413 for a character memory 403. The drawing unit 401 for controlling the image screen also controls in duplex. Further, since the sizes and the display positions of the characters are preset, the application is limited.

FIG. 2 shows a prior art image-only display device 500 disclosed in Japanese Laid-Open Patent Application 3-23916 "Method of Writing Characters into an Image Memory". When a drawing unit 501 is to display an image (profile) of characters on an image screen 506, an image write-in unit 504 writes image data of the image of the characters corresponding to the character codes from a table of a character font memory 503 to an image memory 502. This system is less expensive than the duplex type display device of FIG. 1 by the elimination of the character memory, and the characters may be enlarged or reduced at any positions by processing the image data from the character font dot by dot. (This is hereinafter called a depiction type display device).

Naturally, image data of characters is written into the image memory 502 and the information as character codes has been lost. Accordingly, when a text is to be edited, the entire image data of the depicted character image must be controlled by the drawing unit. If the character image spreads over the entire image screen, the same memory capacity as that of the character memory 403 which is omitted from the duplex type display device 400 is required in order to control the image of the depicted characters. Further, where the update of the characters is frequently done, the time required to depict the characters accumulatively increases. Thus, it is not suitable to process a large amount of characters.

When an image and characters are to be displayed in mixture, the prior art duplex type display device needs large hardware but a freedom of character display (particularly, a freedom of display position) is limited. In the depiction type display device, the freedom of the character display position and the display size is improved, but when a text is to be edited with a high frequency of character update, the depiction time is relatively long and a burden to the depiction unit is heavy.

SUMMARY OF THE INVENTION

It is therefore an object of the present invention to provide an apparatus which permits a display device for displaying image information and a character information in mixture to edit a text by character codes without duplexing a memory unit and with a freedom of character display.

It is one object of the present invention to provide a display method of the present invention for outputting image data of a bit map to be displayed on a raster scan type display and a pattern of font corresponding to a code of a character, symbol or graphics having the predetermined code assigned thereto to the display for displaying the image and the character, symbol or graphics corresponding to the code on the display, comprising the steps of; adding identification data for discriminating the code from the image data to the code and storing the code in a memory together with the image data; sequentially reading the code together with the image data from the memory; and outputting a pattern of the font corresponding to the code having the identification data added thereto to the display when the identification data is detected.

The identification data may comprise start data for indicating the start of display of the font corresponding to the code and slave data for controlling the display.

The slave data may comprise row data and color data, a pattern of the row corresponding to the row data of the font may be outputted to the display and the pattern may be colored by the color data for displaying.

The image data may be outputted to the display when the identification data is not detected.

At least a portion of the font may be stored in the memory.

A sum of data lengths of the identification data and the code may be equal to a sum of lateral dots of the font.

It is another object of the present invention to provide a display control circuit comprising detection means for detecting the presence or absence of identification data in data read-out from a memory for storing the identification data, code, and image data, in which the code is corresponding to a predetermined character, symbol or graphics, the identification data is added to the code, and the image data is displayed on a raster scan type display as a bit map; a font memory for storing the character, symbol or graphics corresponding to the code in a form of font; and output control means for reading the pattern corresponding to the code having the identification data added thereto from the font memory and outputting the pattern of the font.

The identification data may comprises start data for indicating the start of display of the font corresponding to the code and slave data for controlling the display, the detection means may further detect the slave data, and the output control means may control the display in accordance with the slave data and outputs the result to the display.

The output control means may output the image data to the display when the identification data is not detected.

At least a portion of said font memory may be rewritable.

It is further another object to provide a display device of the present invention comprising a raster scan type display; a font memory for storing a character, symbol or graphics having a predetermined code assigned thereto in a form of font corresponding to the code; a memory for storing an image to be display on the display as image data of a bit map and the code having identification data added thereto for discriminating the code from the image data; and display control means for sequentially reading the code together with the image data from the memory, detecting the presence or absence of the identification data, discriminating the code having the identification data added thereto from the image data, and outputting a pattern of the font corresponding to the code or the image data to the display.

The identification data may comprises start data for identifying the start of display of the font corresponding to the code and slave data for controlling the display.

The slave data may comprise tonality data for setting a tonality to be displayed and the display, and a pattern of the corresponding row of the font may be outputted to the display by the tonality determined by the tonality data.

The image data may be outputted to the display when the identification data is not detected.

At least a portion of the font may be rewritable.

The font may be of different sizes.

The font may be $8 \times 10$ size.

The data stored in the memory may be sequentially outputted to the display control means.

A sum of data lengths of the identification data and the code may be equal to a sum of lateral dots of the font.

In the display method of the present invention, the code having the identification data for discriminating the code from the image data added thereto is stored in the memory together with the image data, and the code and the image data are sequentially read out to display them on the display. When they are read, the readout of the code having the identification data added thereto is detected by the identification data. A pattern of the font corresponding to the code is outputted to the display so that the pattern of the font corresponding to the code is displayed on the display. Thus, even if the code and the image data are mixedly stored in the memory, the pattern of the character, symbol or graphics corresponding to the code can be displayed.

Where the identification data comprises start data and slave data, a pattern of the font of the corresponding row may be outputted to the display based on the slave data, and the pattern may be displayed with color. By setting the start data and the slave data in various ways, the character, symbol or graphics corresponding to the code may be colored in various ways in various sizes.

Where the identification data is not detected, the image data is outputted to the display so that both of the image represented by the image data and the pattern of the character, symbol or graphics corresponding to the code can be displayed even if the code and the image data are mixedly stored in the memory.

By storing at least a portion of the font in the memory, the updating of the font stored in the memory can be attained so that more versatile display is attained.

In the display control circuit of the present invention, the data read from the memory includes both the image data and the code, and either of the image data or the code are discriminated by the presence or absence of the identification data detected by the detection means. When the identification data is detected, the output control means reads out the pattern corresponding to the code having the identification data added thereto, from the font memory. This pattern is the font of the character, symbol, or graphics corresponding to the code, that is, the image data of the bit map to be display. In this manner, the code and the image data are discriminated so that the image data of the bit map of the character, symbol or graphics corresponding to the code can be outputted even if the code and the image data are mixedly stored in the memory.

In the display device of the present invention, the pattern corresponding to the code having the identification data added thereto is read from the font memory by the same operation as that of the display control circuit, and it is displayed on the display.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

FIG. 5A and 5B show examples of a content of a font memory;

FIG. 18 shows an example of expanded display of the character A.

DESCRIPTION OF THE PREFERRED EMBODIMENT

The embodiments of the present invention are explained with reference to the drawings. The identical or like elements to those of the prior art are only briefly explained or the explanation thereof is omitted.

Figure 3:
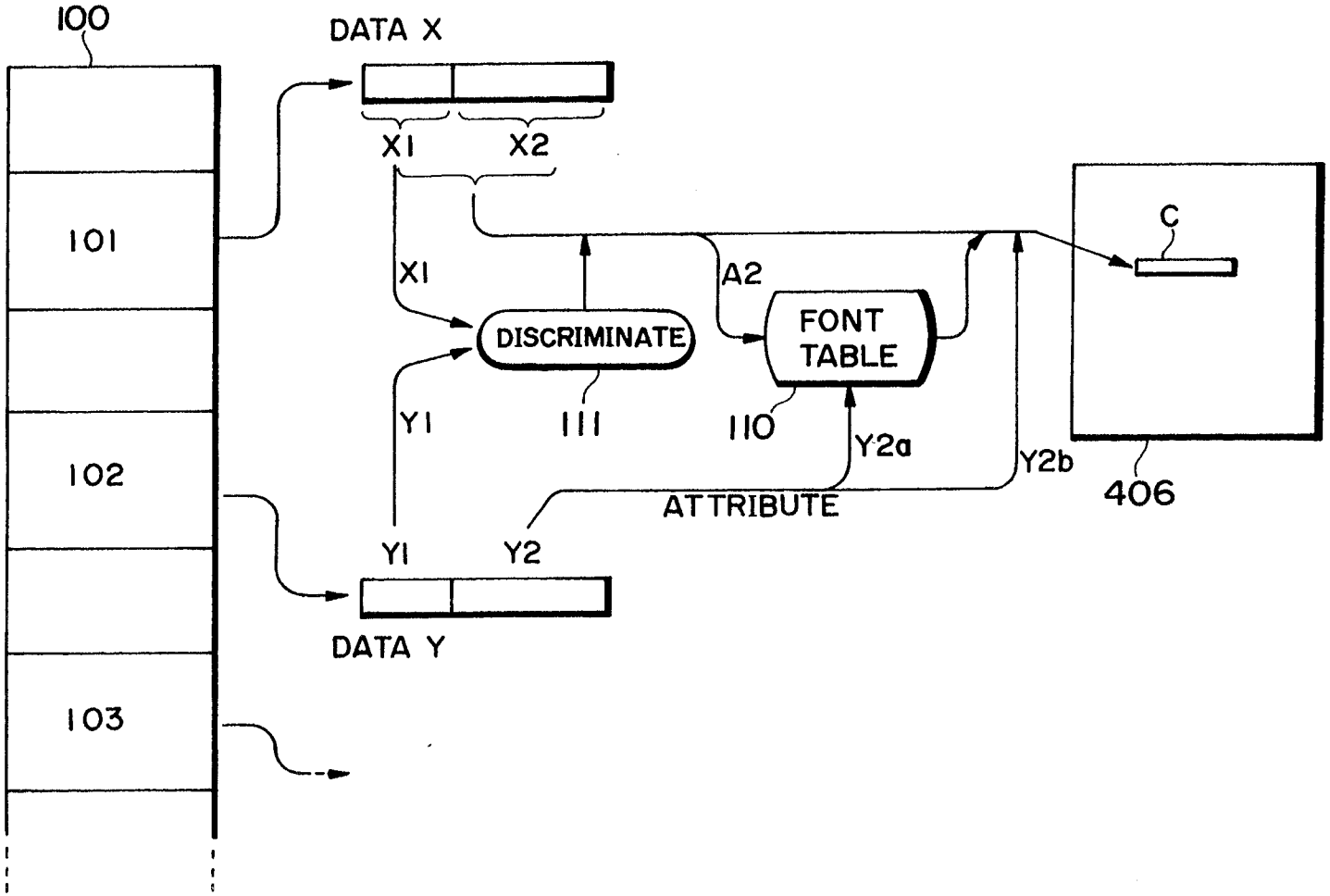
FIG. 3 shows a conceptual view of a display method of the present invention.

FIG. 3 shows a conceptual view of the display method of the present invention. In the present display method, the image is displayed on a raster scan type display 406 in the following manner. There are a plurality of memory areas 101, 102, . . . on the memory 100, and data X on the memory area 101 has a data format comprising blocks X1 and X2, and data Y on the memory area 102 has a data format comprising blocks Y1 and Y2. Identification data and a code (which corresponds to a character, symbol or graphics of a font table 110) are stored in each of the blocks X1 and X2, or image data of a bit map is written therein. The block Y1 stores identification data and the block Y2 stores attribute data. Data Y2*a* of a row address of the font table and data Y2*b* of a display color are written in the attribute data of the block Y2.

The data X and Y are read from those memory areas in synchronism with the scan of the display 406. Whether the data X is a code or image data is determined based on the identification data written in the blocks X1 and Y1. If a code is in the data X, a pattern designated by the data Y2*a* of the row address in the block Y2, of the image corresponding to the code is read from the font table. The pattern C is displayed with a color designated by the data Y2*b* of the display color at a point on the display 406 corresponding to the address of the memory area 101.

Identification data and other attribute data, or the identification data and codes or image data of a bit map are stored in a memory area 103 other than the memory areas 101 and 102. Where the identification data and other attribute data and codes are stored, whether it is a code or image data is determined based on the identification data in the memory areas 101 and 102 and it is displayed on the display 406. Where the image data of the bit map is stored, it is displayed on the display 406 without determining whether it is a code or image data. "Namely, it merely functions as a graphic memory."

The present display method is specifically explained by a simple embodiment. In the present embodiment two memory areas 101 and 102 are provided, the data X is of 8-bit length, the block X1 is of 1-bit length and block X2 is of 7-bit length. The data Y is of 8-bit length, and the blocks Y1 and Y2 are of 1-bit length and 7-bit length, respectively. The font memory is $8\times10$. When both the block X1 and the block Y1 are "1", an ASCII code is written in the block X2.

Figure 1:
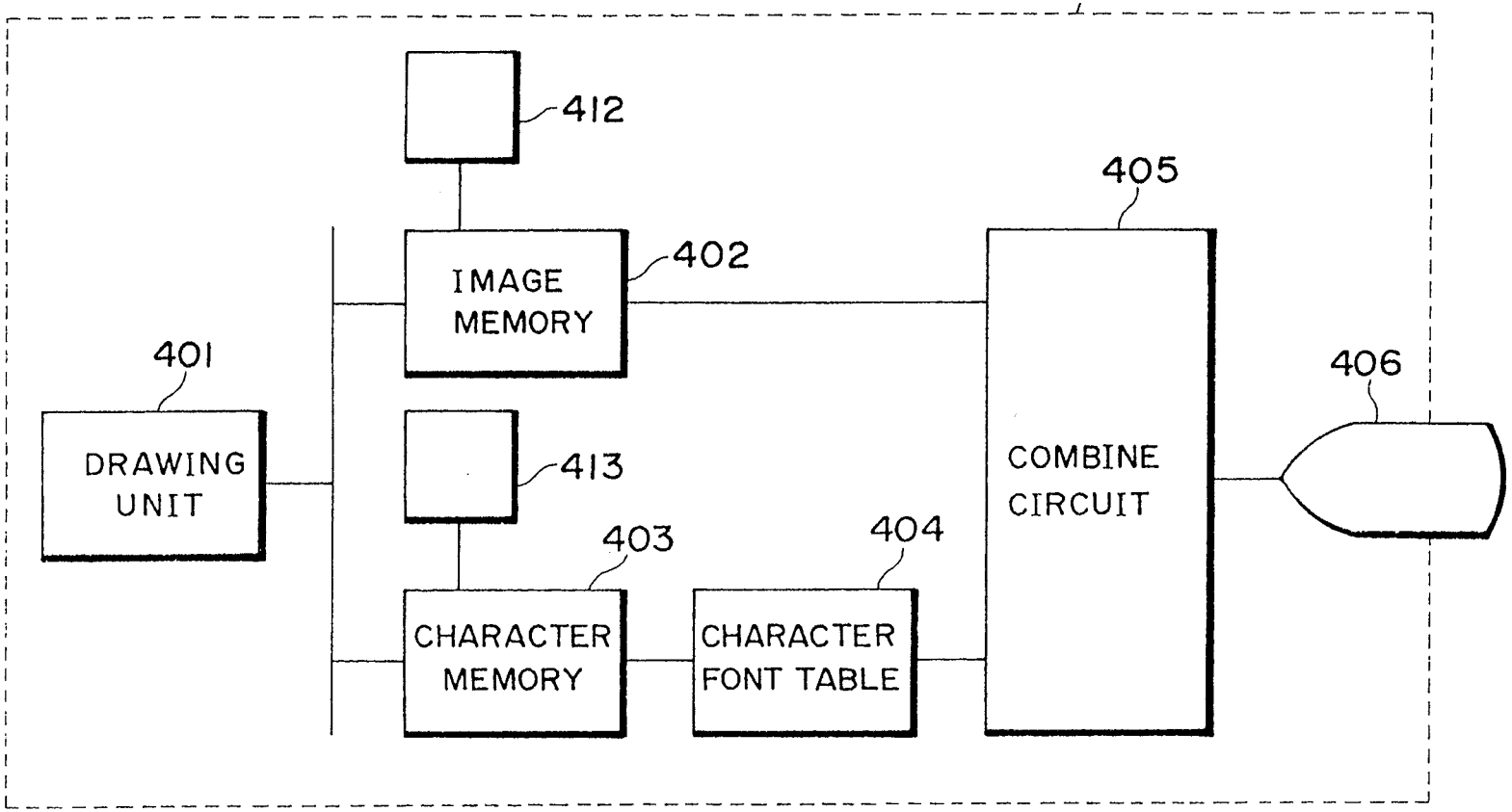
Fig. 1 (PRIOR ART)
FIG. 1 shows a prior art configuration.
Figure 2:
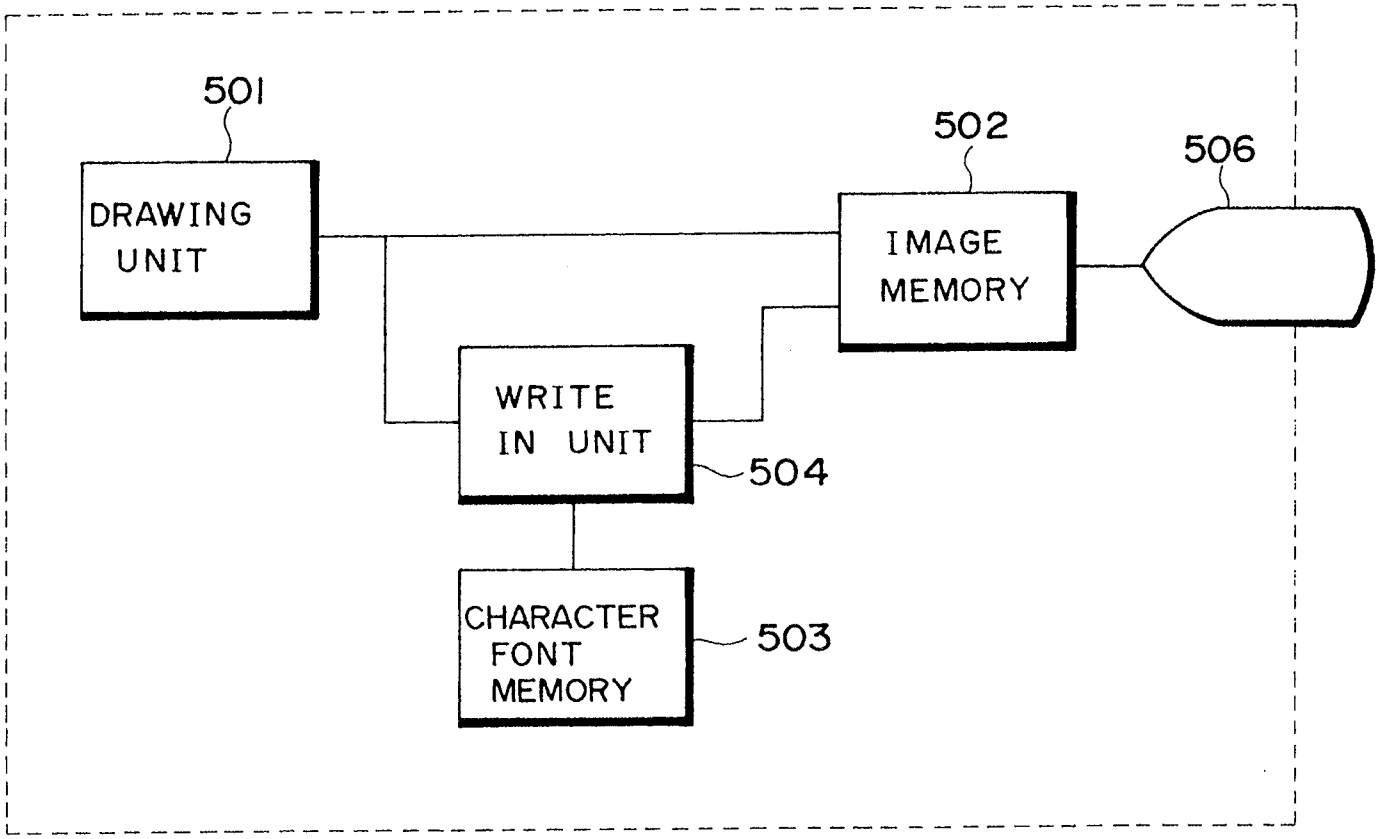
Fig. 2 (PRIOR ART)
FIG. 2 shows a prior art configuration.
Figure 4A:
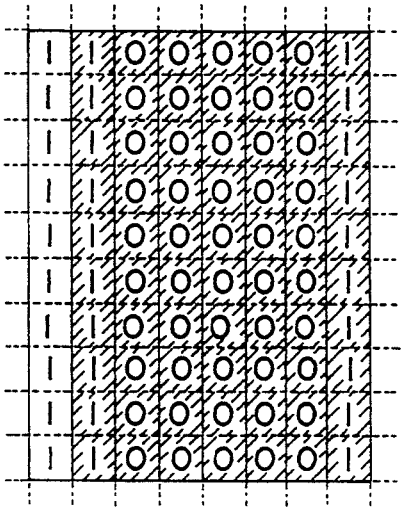
FIG. 4A and 4B show examples of data written in a memory 100, associated with a display 100.

In FIG. 4A, identification data "1" as the data X and an ASCII code "41H(1000001=41, where H represents a hexadecimal notation) are written in the memory area 101 at a position corresponding to a display position on the display 406. In FIG. 2(*b*), identification data "1" as the data Y and attribute data are written in the memory area 102 at a position corresponding to the display position of FIG. 4A. The data Y2*a* of the row address of the attribute data is of 4-bit length (hatched area) in which 9-OH is written, and the data Y2*b* of the display color is of 3-bit length, that is, of 8-level tone, in which "1" is written. FIGS. 5A shows a font of the ASCII code "41H"(character A) and FIG. 5B shows a font of the ASCII code 42H (character B).

Figure 6:
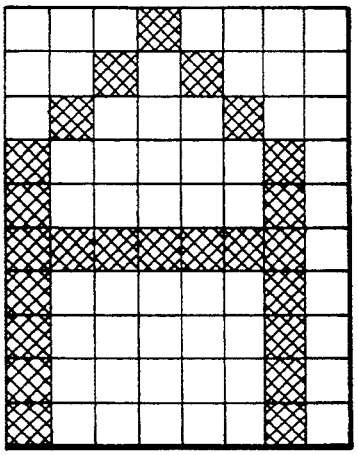
FIG. 6 shows an example of display of character A.
Figure 7:
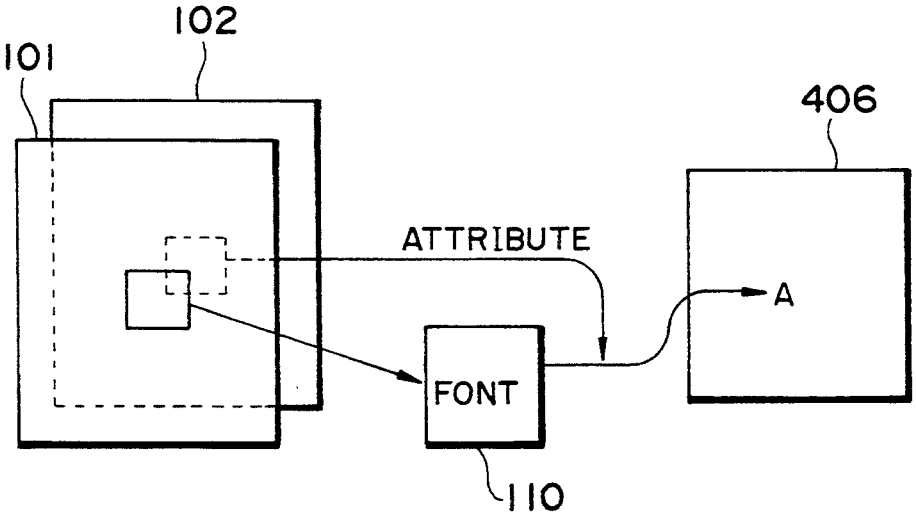
FIG. 7 illustrates an operation of FIGS. 4A and 4B in the display method of the present invention.

When the data X and Y are read from the memory areas 101 and 102 when the data X in FIG. 4A is to be displayed on the display 408, the data of the block X2 is determined as the ASCII code because both identification data are "1". In FIG. 4A, the ASCII code is 41H and the display color data Y2*b* of the attribute data is "1". A pattern of the row corresponding to the data Y2*a*, that is, 9-OH of the row address of the attribute data of the font (character A, FIG. 5A of the ASCII code 41HS is read from the font table 110. When the scan of the display 408 is at the top row, the data Y2*a* of the row address is 9H (FIG. 5B) so that the top (row address 1001) pattern of FIG. 5A is read and it is displayed by the color designated by the data Y2*b* of the display color. When the scan is at the second row, the data Y2*a* of the row address is 8H so that the second (row address 1000) pattern of FIG. 5A is read and displayed. This is repeated until the bottom row (row address 0000) is reached. In this manner, the patterns of the rows are sequentially displayed on the display 406 at the positions corresponding to the addresses of the memory area 101 with the color designated by the data Y2*b* of the display color as shown in FIG. 6. It is diagrammatically shown in FIG. 7.

Figure 8:
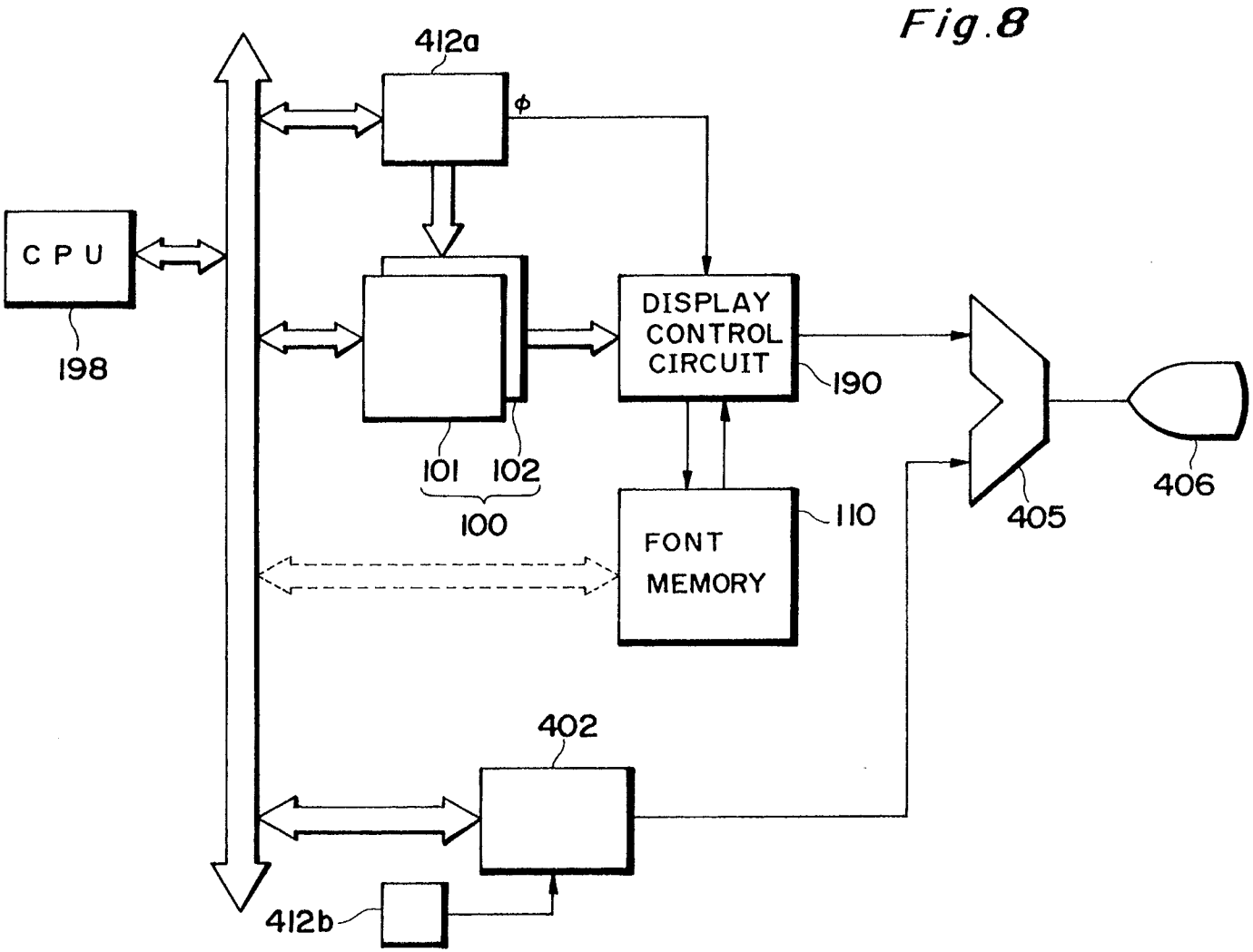
FIG. 8 shows a configuration of a display device which uses the display method of the present invention.

An embodiment of the display device for displaying in the display method of the present invention is now explained. The display device of the present embodiment has two memory areas 101 and 102 in the above display method and uses the data length of 8 bits. FIG. 8 shows a configuration thereof. The respective elements of the display device are now explained.

The memory 100 comprises two memory area 101 and 102, and the memory area 101 stores image data and character codes in the mixed format, with the bit map of one page or field of data. The memory areas 101 and 102 are constructed such that data thereof correspond to dots on the display 406. The memory area 101 stores the identification data (1 bit) and the codes (7 bits) or the image data (8 bits), and the memory area 102 stores the identification data (1 bit) and the attribute data (row address data: 4 bits and display color data: 3 bits).The data formats are identical to those described before. The data of the memory areas 101 and 102 are written by the write operation of a CPU 198 or by a DMA (not shown).

Figure 9:
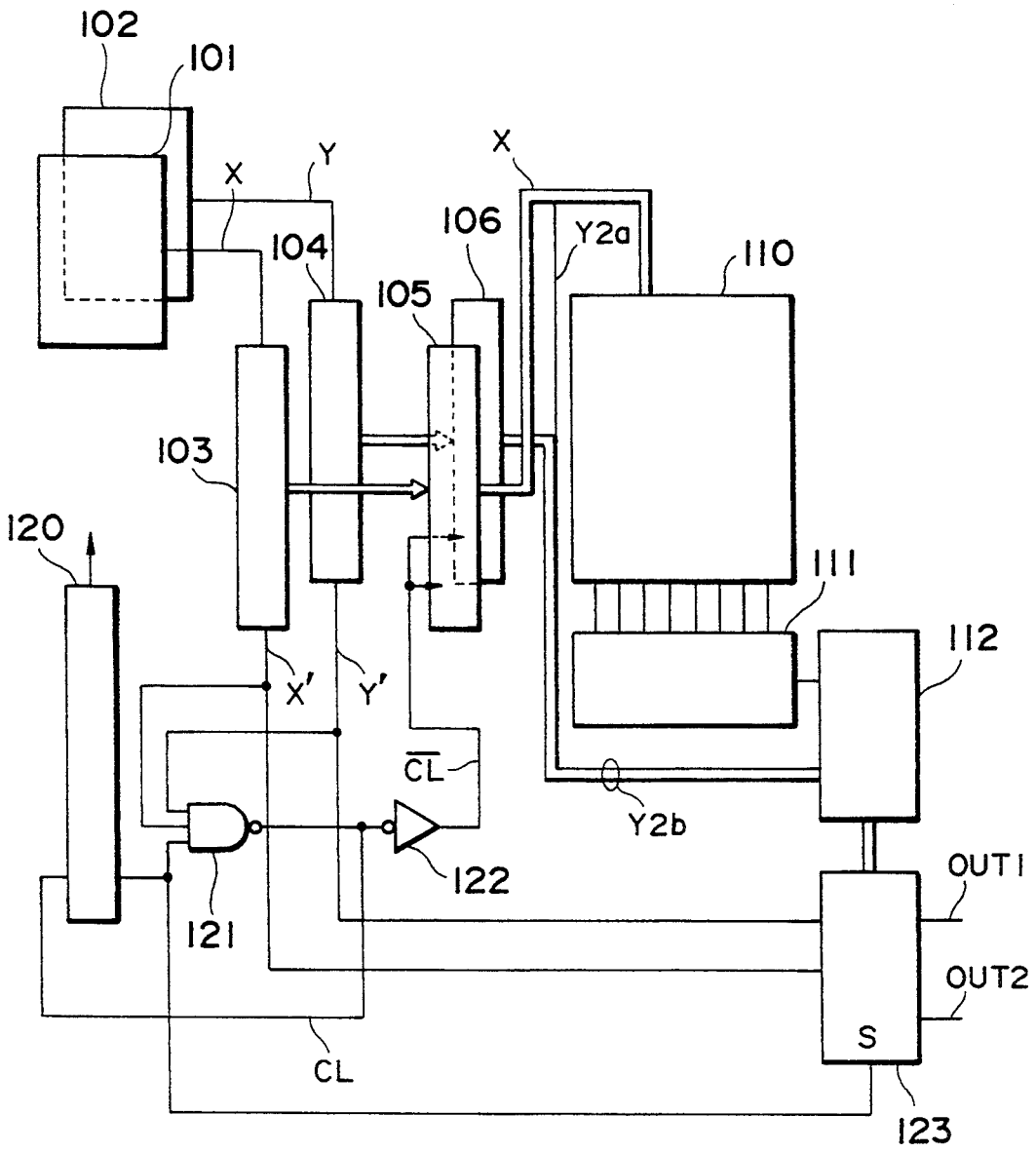
FIG. 9 shows a configuration of a display control circuit of the display device of FIG. 6.

The display control circuit 190 determines whether the data X is code or not based on the identification data read from the memory areas 101 and 102. When the data X is the code, that is, when the identification data of both of the memory areas 101 and 102 are "1", a pattern designated by the data of the row address, of the image corresponding to the code is read from the font memory 110, and it is outputted to the display 406 with the color designated by the display color data. When the data X is image data, the data X is outputted to the display 406. FIG. 9 shows a specific configuration of the display control circuit 190. In FIG. 9, the memory 100 and the font memory 110 shown in FIG. 8 are again shown to illustrate the connection.

In the display control circuit 190 of FIG. 9, the data is serially outputted from the memory 100. It comprises 8-bit serial-in parallel-out shift registers 103, 104 and 111, 7-bit latches 105 and 106, a shift register 120, a NAND gate 121, a data selector 123, an attribute circuit 112 and an invertor 122.

The shift registers 103 and 104 are provided for the memory areas 101 and 102, respectively, and they are shifted by a clock signal $\phi$(CLOCK) which is in synchronism with the display of dots by the display 406 to paralllize the data from the memory 100. (The clock signal (CLOCK)is omitted by a convention of notation of a synchronous digital circuit). Where the data is parallely outputted from the memory 100, this circuit is eliminated or replaced by a latch or D-type flip-flop. The shift register 120 outputs a low signal for an 8-clock period to the NAND gate 121 when the output of the NAND gate 121 is high, and it functions as an 8-clock timer. The shift register 120 may be substituted by a timer circuit or a one-shot multivibrator. The data selector 123 receives the outputs X' and Y' of the final stages of the shift register 103 and 104. When the identification data of both of the data X and Y are "1", the selector input S is low so that it outputs the signal from the attribute circuit 112 to the display 406. When one of the identification data is "0", it outputs the output X' of the shift register 103 to the display 406. The attribute circuit 112 renders the R, G and B outputs to the high level in accordance with the bits of the display color data Y2*b* to color the pattern from the font memory 110. It is frequently used in a CRT controller.

An image memory readout control circuit 412*a* is similar to that shown in the prior art and it outputs the address corresponding to the display position of the display 408 to the memory 100 in synchronism with the scan of the display 408. The display positions of the display 408 and the addresses of the memory areas 101 and 102 are read in correspondence, and a clock signal $\phi$ for the address generation is outputted to a display control circuit 190 (shift registers 103 and 104) for synchronization an operation mode of this circuit is set by a command from the CPU 198.

The font memory 110 stores images of characters, symbols or graphics corresponding to the codes, and a pattern of a row of the image is stored at an address of the memory 100 designated by the code. For the image of FIG. 5A, the pattern of the row is stored as data 82H in the row OH. A portion of the font memory 110 is rewritable by the CPU 198.

An image memory 402 and an image memory readout control circuit 412*b* are identical to the image circuit shown in the prior art and they output the image data from the image memory 402 to the display 408. It is synchronized with the image memory readout control circuit 412*a*, and a combine circuit 405 combines the image data from the display control circuit 190 and the image memory 402 to output it to the display 406. The image memory 402 and the image memory readout control circuit 412*b* correspond to the step of displaying on the display 406 without determining whether it is a code or image data in the above method.

An operation of the device is now explained.

Figure 10:
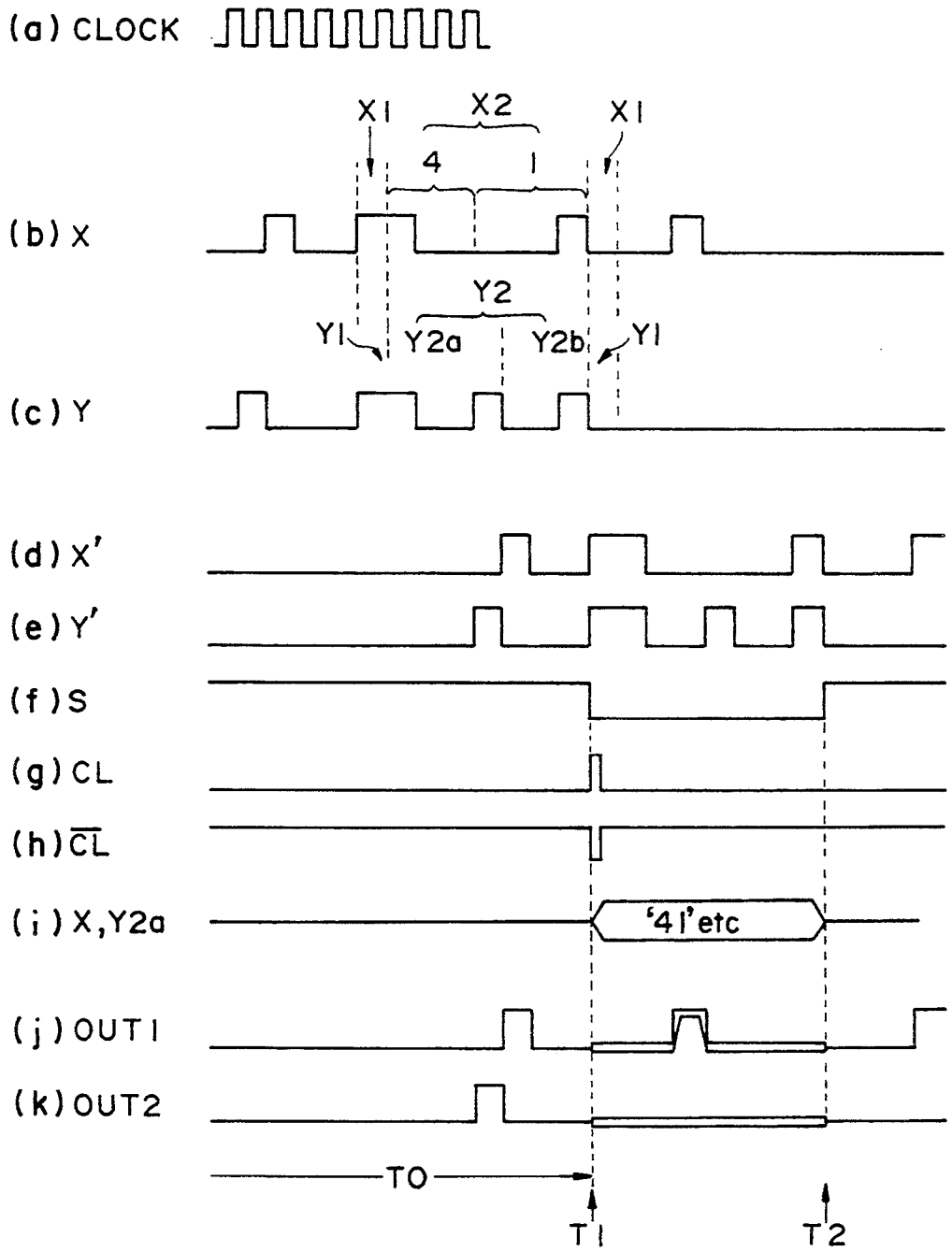
FIGS. 10*a–k* show a timing chart of the display control circuit.

The data X and Y stored in the areas 101 and 102 of the image memory 100 are sent out in synchronism with the scan cycle of the display 406. The display control circuit 190 determines whether the data X from the identification data of the blocks X i and Y1 are codes or image data. If the data X are codes, a pattern designated by the row address data, of the image corresponding to the code is read from the font memory 110, and it is outputted to the display 406 with the color designated by the display color data. If the data X is the image data, the image data is outputted. Signal waveforms in the display control circuit 190 are shown in FIG. 10. The operation of the display control circuit 190 is explained with reference to FIG. 10.

The data X and Y from the memory areas 101 and 102 are shifted by the shift registers 103 and 104 by the clock signal $\phi$ (CLOCK. The data X and Y are parallelized and held in the latches 105 and 106, and they are delayed by an eight-clock period and outputted from the shift registers 103 and 104 as data X' and Y'. In FIG. 10(*a*) shows the clock signal (CLOCK), (*b*) shows the data X (*c*) shows the data Y, (*d*) shows the data X' and (*e*) shows the data Y'.

In a time period TO in which both of the identification data of the blocks X1 and Y1 of the data X' and Y' are not "1", the output signal of the shift register 120, that is, the select input S of the data selector 123 is high (FIG. 10(*f*). The data selector 123 selects the outputs of the shift registers 103 and 104 and outputs them to the display 406. The outputs to the display 406 are OUT1 and OUT2 which are delayed versions of the image data from the memory 100 by the shift registers (FIGS. 10(*j*) and 10(*k*)). In this situation, the memory area 101 functions as a one-to-one correspondence bit map memory, and the image data of the memory area 101 is displayed on the display 406.

When both of the data X' and Y' are "1" (high), that is, when both of the identification data of the data X' and Y' are "1" (at a time T1), the output CL (FIG. 10(*h*)) of the NAND circuit 121 is low. This output is supplied to the latches 105 and 106 through the invertor 122 to enable the writing thereof. The contents of the shift registers 103 and 104 are held in the latches 105 and 106. The output CL of the NAND circuit 121 is also inverted and it is supplied to the clear input of the shift register 120 so that all internal flip-flops of the shift register 120 are cleared. The output of the shift register 120, that is, the select input S of the data selector 123 is low for the subsequent 8-clock period.

The 7-bit code (41H) of the block X2 of the data X is held in the latch 105 and the code is outputted to the font memory 110. On the other hand, the attribute data is held in the latch, and the high order 4 bits thereof, that is, the row address data Y2*a* are outputted to the font memory 110. The address of the font of the alphabet A (code 41H) stored in the font memory 110 is designated by the code of the block X2, and the pattern of the row designated by the data Y2*a* of the font is designated by the row address data Y2*a* (FIG. 10(*i*)) and the designated pattern is read from the font memory 110. The patterns serial-converted by the shift register 111 and it is supplied to the attribute circuit 112. The data selector 123 outputs the pattern from the font memory 110 in accordance with the output from the shift register 120 (FIGS. 10(*j*) and 10(*k*)).

At a time T2 which is 8-clock period later than the time T1, the output of the shift register 120 is high and the data selector 123 selects the outputs the shift registers 103 and 104 and outputs them to the display 406. The status is same as that at the time TO. When both of the identification data of the data X' and Y' become "1" later, the pattern from the font memory 110 is outputted.

As shown in FIG. 4A, the identification data "1" and the code 41H are written into the memory area 101 in correspondence with the display position on the display 406, and the identification data "1" and the attribute data are written into the memory area 101 as shown in FIG. 2(*b*). Thus, the patterns of the rows of the row address data Y2*a* are sequentially displayed and the display as shown in FIG. 6 appears on the display 406. Since the lateral length of the font, the number of bits of the data X and the number of bits of the data Y are equal, there is no overlap in the display and the data can be continuously read from the memory.

In the present invention, the codes are written into the image memory which is inherently to be used for the image display, and whether it is a code or an image is determined by the identification data in the display scan stage, and if it is the code, a pattern is read from the font memory which stores a plurality of fonts and it is outputted in place of the image data. In this manner, the co-existence of the image information and the code on one memory is permitted.

The data X (the identification data "1" and the code) and the data Y (the identification data "1" and the attribute data) can be written at any position on the memory areas 101 and 102 of the image memory 100 so that characters can be displayed at any positions on the screen. Thus, the present invention has both of the advantage of the character processing method of the duplex display device descried above and the freedom of the display position in the draw type display system coexist in the present invention. Further, the present invention attain the display application which could not be attained in the duplex display device.

Figure 4B:
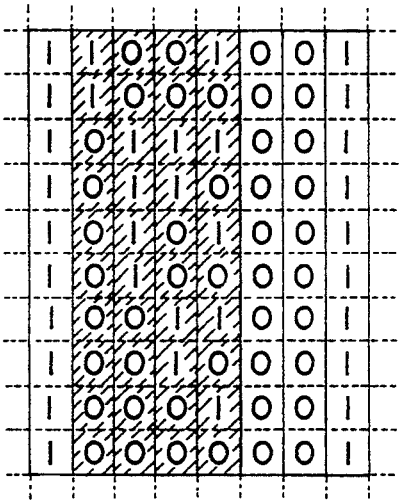
Figure 11:
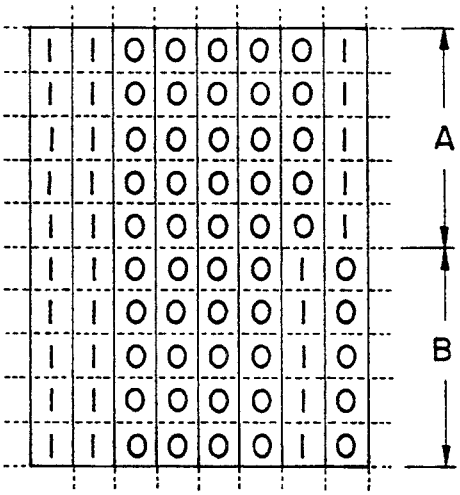
FIG. 11 shows an example of data for displaying a combination of characters A and B.
Figure 12:
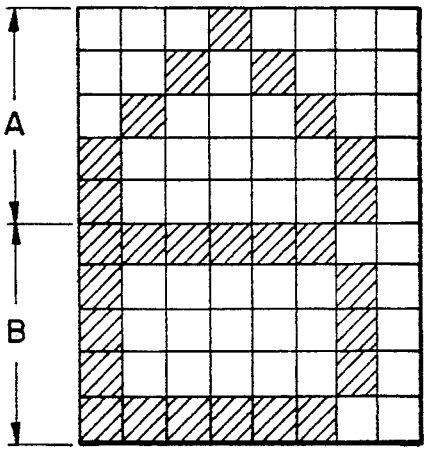
FIG. 12 shows an example of display of the combination of the characters A and B.
Figure 13:
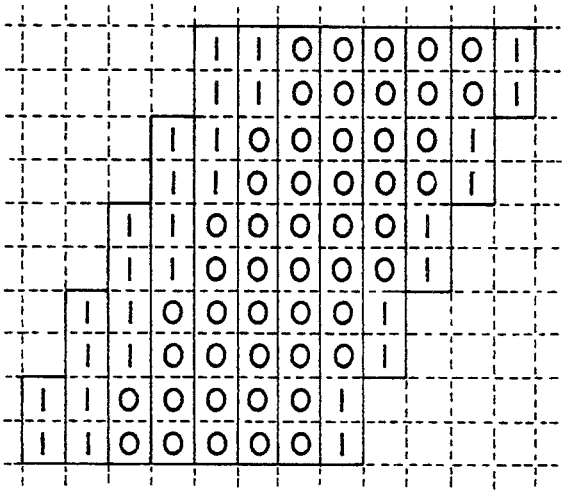
FIG. 13 shows an example of data for obliquely displaying the character A.
Figure 14:
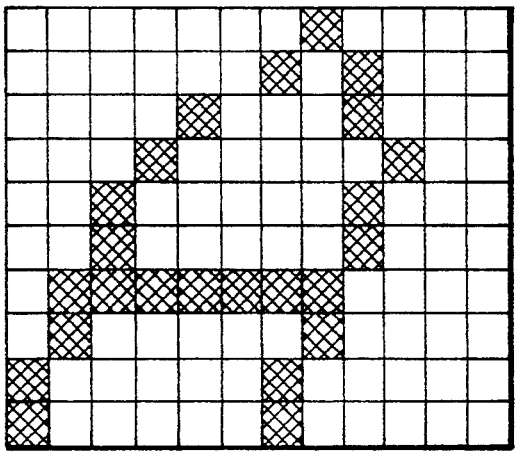
FIG. 14 shows an example of oblique display of the character A.
Figures 15, 16:
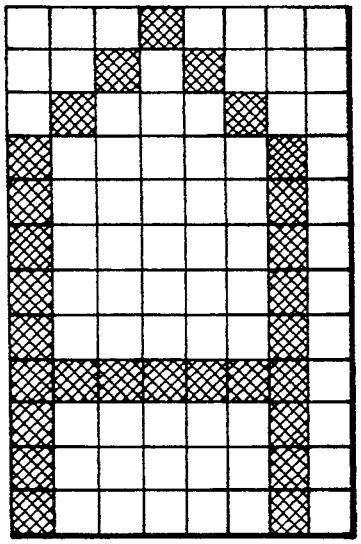
FIG. 15 shows an example of data for displaying the character A in an expanded manner.

For example, where the code in the memory area 101 shown in FIGS. 4A and 4B is modified such that an upper half represents a code 41H and a lower half represents a code 42H as shown in FIG. 11, the display as shown in FIG. 12 appears on the display 406. In the upper half, an upper half(row addresses 9-5H) of the character A is displayed based on the code 41H , and in the lower half, a lower half (row addresses 4-OH) of the character B is displayed based on the code 42H. As a result, a combination of the upper half of the character A and the lower half of the character B is displayed.

Where the identification data "1" and the code 41H are stored in the memory area 101 in such a positional relation that they are staggered by one dot at every second scan line of the display 406 as shown in FIG. 13 and the identification data "1" and the attribute data are also stored in the memory area 102 in the same manner, the display as shown in FIG. 14 appears on the display 406. In this case, since the timing to read the identification data is delayed by one dot at every second scan line, the readout of the pattern from the font memory 110 is also delayed. As a result, the distortion appears as shown in FIG. 14.

Where the rows 1-12 of the memory area 101 are identical to those of FIG. 4A and the data Y (the identification data "1" and the attribute data) of the memory area 102 has the data of the same row address (0101=5H, hatched area in rows 5-7 of FIG. 15) over a plurality of scan lines, the display as shown in FIG. 16 appears on the display 406. In this case, since the pattern of the row 5 of the font of the character A is displayed in the rows 5-7, the display appears extended.

In this manner, high freedom of display is attained, and since the character information is stored in the memory 100 as the codes,the character string or the text can be readily edited. A special symbol as used in a mathematical formula (for example, sigma symbol, root symbol, delta symbol etc.) can be displayed in a more natural style due to the high freedom of display. The present invention is effective to record and display mixture of such a special symbol and a mathematical formula, lines in a table and a modification character (delete line, underscore, marking, etc.), and mixture of typed text and hand-written signature. Where the present invention is combined with a raster-vector converter such as a pattern reader or a hand-written character recognition device, a combination of the typed characters, the hand-written characters and the graphics can be displayed with a simple construction. Thus, the device can be reduced in size and cost.

By changing the addresses at which the data X and Y are stored in the memory areas 101 and 10Z, the display position of the character symbol or graphics corresponding to the code of the data X can be quickly moved, and the present invention can be applied to such an apparatus. For example, it may be applied to a displacement display control system for an identification segment in a radar apparatus, a window display control system in a multi-window display system, or a display method of a cursor or character in a conventional image display device. It is particularly useful in an apparatus which needs effective utilization of a memory where the character, graphic image, cursor and so on are mixedly displayed on the display screen.

In the display device, it is necessary to have an operator recognize a specific position on the display screen, and a recognition mark such as a cursor (? for character and an arrow for a mouse) to point the position is frequently displayed on the display screen. One cursor is usually used for one display screen and the shape thereof is fixed. In the present invention, a character, symbol or graphics corresponding to an appropriate code may be used as a cursor and the shape of the cursor may be changed by changing the code or the corresponding graphics. A plurality of graphics may be combined for use as the cursor, or it may be separated for use as the cursor.

In FIG. 8 the memory 100 and the font memory 110 are separately shown, but where the capacity of the memory 100 is sufficiently large (such as a bank memory), the font memory 110 may be provided in the memory 100. It is provided in other area than the memory areas 101 and 102 in which the identification data, the code and the attribute data are stored. In this case, the attribute data is the address of the area of the font memory on the memory 100 or a plane number of the bank. By updating the address or the number periodically, the display screen may be moved (such AS SCROLL). Since the identification data, the code and the attribute data are processed in the same memory as that for the font, the image data can be dynamically processed and the present invention is applicable to the multi-window display and the animation display.

In the present embodiment, two memory areas are used for one display dot of the display 406, although it may be readily modified to use three or more memory areas. In this case, other attribute data than that in the memory area 102 is stored in the third and subsequent memory areas and additional attribute functions such as vertical and horizontal reversal of a character, rotation and blinking can be attained by those attribute data.

Only one memory area may be used for one display dot. In this case, the image data and the code cannot be discriminated and the image and the character cannot be mixedly displayed. However, the character, symbol or graphics corresponding to the code can be displayed by storing the identification data and the code in the memory area.

In the present embodiment, the data length of the data stored in the memory area 101 and 102 is 8-bit length, although a longer data length may be used. In this case, since the area to store the attribute data is larger, attribute function such as enlargement or reduction along the scan direction may be attained in addition to the attribute functions mentioned above. Those attribute functions may be attained by a circuit in a conventionally used CRT controller. Where the data length is 16 bits or longer, the data stored in the memory area 101 may Kanji code or other 16-bit code and the freedom of display is further enhanced.

In the present embodiment, the font is 8×10 dots, that is, 8 dots in one row, and the data length of the data X and Y stored in the memory areas 101 and 102 is 8-bit length. Thus, in order to change the display position of the character, symbol or graphics corresponding to the code, it is necessary to charge each row. For example, where the displayed character A as shown in FIG. 6 is to be changed to the character B, the portion (hatched area) in which the code of FIG. 4A is stored is to be changed from the code 41H to the code 42H. To improve the above method, three or more memory areas may be provided or the data length may be longer than 8 bits and data Y2*c* for the number of lines to display the pattern may be added to the attribute data. In this case, a register for holding the data Y2C for the number of lines to be displayed and a control circuit (which may be readily constructed by a standard logic) for controlling the update timing of the shift register based on the content of the register and HSYNC from the display 406 are added. Thus, the display position of the character, symbol or graphics corresponding to the code can be moved by updating the data X and Y or one line length of the font.

In the prior art duplex display device, the fonts of different sizes cannot be displayed. The present invention attains it by adding font size data Y2*d* to the attribute data. In this case, a register for holding the data Y2*d* and another control circuit (which may also be readily constructed by a standard logic) for controlling the timing of the shift register 120 based on the content of the register and the clock signal (CLOCK) are added. Thus, different fonts (such as Kanji font) of 16×16 and 24×24, in addition to the font of 8×10 can be discriminated by the data Y2*d* and the fonts of different sizes can be mixedly displayed.

In accordance with the present invention, the pattern of the character, symbol or graphic corresponding to the code can be displayed even if the code and the image data are mixedly stored in the memory. Thus, the code and the image data can be mixedly written into any position in the memory, and the present invention is applicable to an apparatus for displaying the character, symbol or graphics corresponding to the code at a desired position on the display, such as a radar display device. By changing the position on the memory at which the code is written, the character, symbol or graphics corresponding to the code can be quickly moved. Thus, the present invention is applicable to a display device for multi-window display or animation display.

Where the identification data comprises the start information and the slave information for controlling the display, more versatile display may be attained by setting the start information and the slave information in various manners. Accordingly, the character, symbol or graphics corresponding to the code may be displayed in different size or different colors, and the present invention is applicable to a display device which requires free display with versatile processing.

Where the identification data is not detected, the image data as well as the pattern of the character, symbol or graphics corresponding to the code are displayed. Thus, a file having the code and the image data in mixture can be edited. Thus, the present invention is applicable to a display device to be used for the edition of a document which includes characters and graphics or a special symbol (integration symbol, sigma symbol, etc.), lines and hand-written characters.

Where at least a portion of the font is stored in the memory, the rewriting of the font is permitted and the pattern of the character, symbol or graphic corresponding to the code can be set in various manners.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A display method for displaying a bit-mapped image data including an identification data and line pattern composing a font of a character, a symbol, or a graphic having the predetermined code assigned thereto on a raster scan type display, said identification data for discriminating between said image data and said code, said display method comprising the steps of:

a. defining a storing region of a bit-mapped memory by said identification data, said storing region having a predetermined bit-length;

b. storing said bit-mapped image data into said bit-mapped memory, and said code joined with said identification data into said storing region of said bit-mapped memory., said identification data including a value for addressing a line pattern of said font corresponding to said code;

c. sequentially reading out one of said bit-mapped image data and said code with said identification data from said bit-mapped memory; and d. displaying said line pattern addressed by said identification data on said raster scan type display, said line pattern composing said font corresponding to said code with said identification data read out from said bit-mapped memory.

2. A display method according to claim 1 wherein said bit-mapped image data in said bit-mapped memory is displayed on said rater scan type when said identification data is not detected in said bit-mapped memory.

3. A display method according to claim 1 wherein a part of a group including said fonts are stored in said bit-mapped memory.

4. A display method according to claim 1 wherein said identification data comprises a start data for indicating a display start point on said raster scan type display and slave data for the display control.

5. A display method according to claim 4, wherein said slave data comprises a value for addressing said line pattern of said font to be displayed on said display and a color data for coloring said line pattern on said display.

6. A display method according to claim 4 wherein a bit-length of said storing region of said bit-mapped memory is equal to a sum of lateral dots of the font as said line pattern to be displayed on said raster scan type display, said storing region storing said code with said identification data.

7. A display control circuit comprising:

a. a font memory for storing a line pattern to be displayed on a raster scan type display, said line pattern composing a font of a character, a symbol, or a graphic having a predetermined code assigned thereto;

b. a bit-mapped memory storing a bit-mapped image data to be displayed on said display, said bit-mapped image data including an identification data discriminating between said bit-mapped image data and said code, and storing said code joined with said identification data into a region of said bit-mapped memory defined by said identification data, said identification data including an address of said font memory for addressing said line pattern to be displayed on said display;

c. detecting means for detecting said identification data stored in said bit-mapped memory; and d. output means for displaying said line pattern addressed by said identification data at a display point on said display, said display point corresponding to storing point of said bit-mapped memory and said line pattern composing said font corresponding to said code.

8. A display method according to claim 7 wherein said identification data comprises a start data for indicating a display start point on said raster scan type display and a slave data for said display control, said slave data comprising an address of said font memory storing said line pattern to be displayed on said display and a color data for coloring said line pattern on said display, said detection means further detects the slave data, and said output control means performs the display control in accordance with a content of said slave data.

9. A display control circuit according to claim 7 wherein said output control means outputs said bit-mapped image data in said bit-mapped memory to said raster can type display when said identification data is not detected in said bit-mapped memory.

10. A display control circuit according to claim 7 wherein a predetermined area of said font memory is rewritable.

11. A display device comprising:

a. a raster scan type display;

b. a font memory for storing a line pattern to be displayed on the raster scan type display, said line pattern composing a font of a character, a symbol or a graphic having a predetermined code assigned thereto;

c. a bit-mapped memory for storing bit-mapped image data to be displayed on said display, said bit-mapped image data including an identification data discriminating between said bit-mapped image data and said code, and storing said code joined with said identification data into a region of said bit-mapped memory defined by said identification data, said identification data including an address of said font memory for addressing said line pattern to be displayed on said display; and d. display control means for sequentially reading out one of said bit-mapped image data and said code with said identification data, detecting said identification data, and displaying said line pattern addressed by said identification data at a display point on said display, said display point corresponding to storing point of said bit-mapped memory and said line pattern composing said font corresponding to said code.

12. A display device according to claim 11 wherein said identification data comprises a start data for identifying a display start point on a raster scan type display and a slave data comprising an address of said font memory storing said line pattern to be displayed on said display and a color data for coloring said line pattern on said display.

13. A display device according to claim 12 wherein said slave data further comprises tonality data for setting a tonality to be displayed on said display and said line pattern of said font is displayed on the basis of said tonality data.

14. A display device according to claim 11 wherein the bit-mapped image data in said bit-mapped display is displayed on said raster scan type display display when said identification data is not detected in said bit-mapped memory.

15. A display device according to claim 11 wherein a predetermined area of said font memory is rewritable.

16. A display device according to claim 11 wherein each said font stored in said font memory is a different size.

17. A display device according to claim 11 wherein the font is constructed of $8 \times 10$ dots.

18. A display device according to claim 11 wherein said display control means sequentially outputs one of said bit-mapped image data and said code with said identification data stored in said bit-mapped memory.

19. A display device according to claim 11 wherein a bit-length of said storing region of said bit-mapped memory is equal to a sum of lateral dots of the font as said line pattern to be displayed on said raster scan type display, said storing region storing said code with said identification data.

* * * * *